United States Patent [19]

Wood

[11] 4,404,710

[45] Sep. 20, 1983

[54] APPARATUS FOR FEEDING FIBERS TO CARDING MACHINES AND THE LIKE

[75] Inventor: Dennis E. Wood, Fairport, N.Y.

[73] Assignee: Rando Machine Corporation, Macedon, N.Y.

[21] Appl. No.: 268,326

[22] Filed: May 29, 1981

[51] Int. Cl.[3] ..... D01G 15/40; D01G 23/08

[52] U.S. Cl. ..... 19/105; 19/240; 19/300

[58] Field of Search ..... 19/105, 240, 300

[56] References Cited

U.S. PATENT DOCUMENTS

| | | | |
|---|---|---|---|
| 3,169,664 | 2/1965 | Meincke | 19/105 X |
| 3,728,759 | 4/1973 | Hergeth | 19/105 |
| 4,009,803 | 3/1977 | Lytton | 19/105 X |
| 4,161,052 | 7/1979 | Erben | 19/105 X |
| 4,240,180 | 12/1980 | Wood et al. | 19/300 X |
| 4,280,251 | 7/1981 | Ludwig | 19/105 |
| 4,321,732 | 3/1982 | Erben | 19/105 |

*Primary Examiner*—Louis Rimrodt

*Attorney, Agent, or Firm*—Shlesinger, Fitzsimmons & Shlesinger

[57] ABSTRACT

In a pneumatic system for supplying air-borne fibers to the vertical feed chutes of carding machines and the like, the fibers which collect in the lower, formation section of each chute, are adapted to be compacted by a volumetric air pump that is mounted in each chute to direct pulses of compressed air into the upper end of its formation section. The density of the column of fibers in this section is monitored by apparatus which senses the air pressure differential between the upper and lower ends, respectively, of the formation section, and which generates an electrical signal proportionate to the pressure differential. This signal controls the operation of the variable speed electric motors which drive the air pump and a feed roll, which draws fibers from the upper, surge section of the chute and feeds them downwardly to the formation section. Means is provided for interrupting the operation of the motors whenever the density of the column of fibers in the formation section exceeds predetermined high and low limits. The air pump can also be designed to compact the fibers in the surge section of the chute.

14 Claims, 5 Drawing Figures

APPARATUS FOR FEEDING FIBERS TO CARDING MACHINES AND THE LIKE

BACKGROUND OF THE INVENTION

This invention relates to fiber feeding apparatus and more particularly to improved apparatus for feeding air-borne fibers to carding machines and the like.

It has long been common to employ pneumatic means for supplying air-borne fibers to carding machines and machines for forming non-woven webs or fabrics. In practice, air-borne fibers are deflected from a primary overhead supply duct selectively into each of a plurality of vertically disposed fiber feeding chutes, the lower ends of which communicate with the inlets to the associated carding or web forming machines. Normally a supply of fibers is allowed to collect to a predetermined height in the upper end of each vertical chute above an opening roll, which draws fibers from the supply, as needed, and feeds them downwardly into a formation section in the lower end of the chute.

In order to provide a uniformly thick lap or web at the output of a vertical supply chute, it has been customary in the past to attempt to regulate the degree to which the fibers are compacted in the formation section of the chute, or in other words immediately prior to their being fed to the input of the associated machine. One such means for compacting the fibers in a supply chute is disclosed in U.S. Pat. No. 3,169,664, wherein a reciprocable piston is mounted in communication with the upper end of the formation section of the chute to supply pulses of compressed air which increase the compactness or density of the column of fibers located in the formation section. The piston works in cooperation with a flap valve, which is closed as the piston moves on its expansion stroke so that compressed air is built up within the chute, and which opens during the retraction of the piston so that fresh air is drawn into the chute above the compacted fibers. The effect of the piston is thus uni-directional, since it tends to compact the fibers upon its expansion stroke, but has no effect upon the fibers during its retraction.

In addition to the use of a reciprocable piston, it has been customary also to employ a pivotal bellows or vane pump, which is mounted on a vertical, fiber feeding duct with its discharge end communicating with fibers located in the lower end of the feed chute (for example in the formation section of the chute), thereby intermittently to compress the fibers in this section in a manner similar to that of the above-described piston.

Although these prior piston and bellows-type devices have been designed intermittently to compact the fibers located in the formation section of a feed chute beneath the associated opening roll, they have not been designed also to compact or densify the supply of fibers normally held in the surge section of the chute above the associated opening roll. Moreover, such prior piston and bellows-type devices have normally been positioned above the associated opening roll so as to discharge air pulses into the space between the chute wall and the associated opening roll, thereby increasing turbulence at the point of discharge of fibers tangentially from the feed roll, and also precluding the use of a re-entrant duct of the type disclosed, for example, in U.S. Pat. No. 4,240,180, for the purpose of providing adjustable, generally uniform air flow past the discharge point of the associated opening roll.

Moreover, heretofore there has been no satisfactory means for monitoring and controlling the operation of such prior art pump means in order to produce the desired density of the column of fibers formed in the formation section of a chute.

It is an object of this invention, therefore to provide an improved vane pump or bellows apparatus for compacting the fibers in the formation section of a feed chute of the type described, while at the same time producing a vibratory effect on the fibers located in the upper end or surge section of a feed chute, thereby to control the compaction of fibers in the chute.

A further object of this invention is to provide novel means for applying compaction pressure to the fibers in the lower end of a vertical feed chute, but without interfering with the air pressure in the vicinity of the associated opening roll.

Still another object of this invention is to provide electrical control means for controlling the rate of feeding and compaction of fibers in chutes of the type described, thereby to control the density of the webs produced at the outputs of such chutes.

SUMMARY OF THE INVENTION

In one embodiment of this invention a pivotal, double-vane air pump or bellows mechanism is mounted on a fiber feed chute above the associated opening roll with one vane of the pump disposed intermittently to supply increased air pressure to the bottom of the surge section of the chute, at the same time that a second vane on the pump is imparting increased air pressure to the fibers located in the lower or formation end of the chute. Moreover, each of the two pump vanes is provided with a rubber flap valve for controlling the pressure differential developed by the respective vanes.

In other embodiments a single-vane pump is mounted for pivotal movement on the feed chute with its discharge end located in communication with the formation section of the chute, but beneath the center of the associated opening roll, so that the pump can be employed in combination with a re-entrant duct of the type disclosed, for example, in U.S. Pat. No. 4,240,180.

For each of the different pump embodiments a control mechanism is provided which monitors the density of the column of fibers located in the formation section of the chute, and which controls the electric motors that drive the feed roll and pump means so that the density of the resultant web or lap can be controlled within predetermined tolerances.

THE DRAWINGS

DETAILED DESCRIPTION OF THE INVENTION

Figure 1:
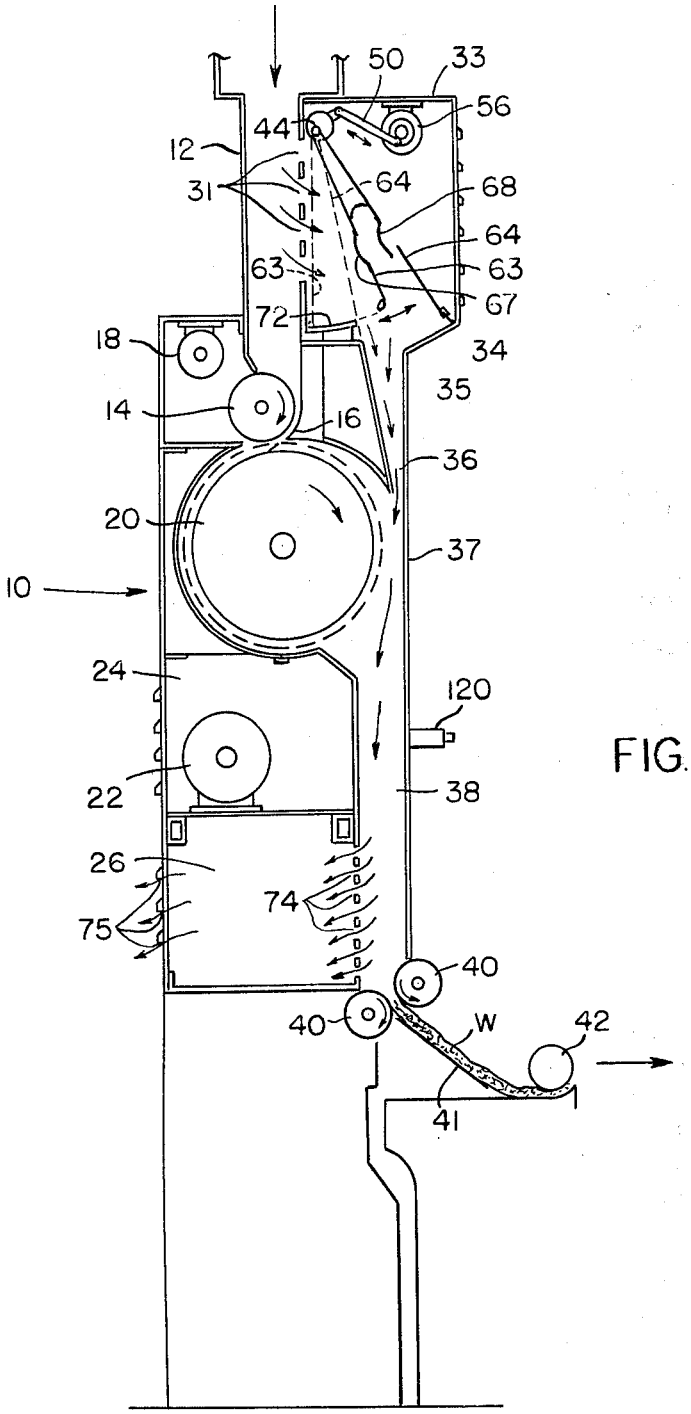
FIG. 1 is a schematic end view of a fiber feeding chute and associated card feeding mechanism made according to one embodiment of this invention.
Figure 2:
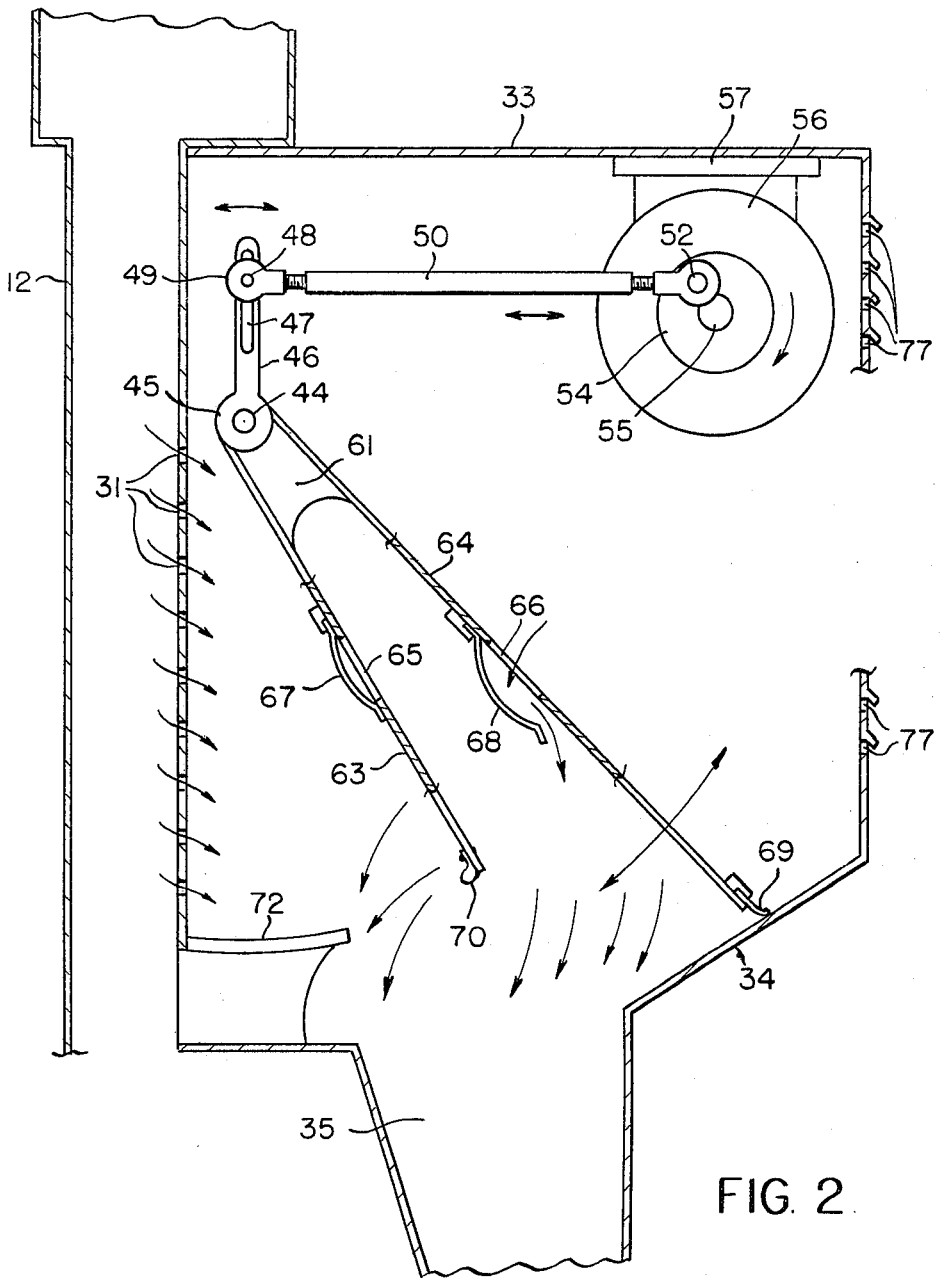
FIG. 2 is a fragmentary schematic view similar to FIG. 1, but showing in greatly enlarged form the type of volumetric air pump which is employed with this embodiment of the feed chute.

Referring now to the drawings by numerals of reference, and first to FIGS. 1 and 2, 10 denotes generally a fiber feeding chute or duct having at its upper end the usual surge section 12. Section 12 communicates at its upper end with a conventional fiber feeding device (not illustrated), which deflects or otherwise intermittently directs air-borne fibers from a main, overhead supply duct downwardly into section 12 in accordance with the rate at which fibers are drawn from the lower end of chute 10 as noted hereinafter. Surge section 12 communicates in the usual manner at its lower end with a feed roll 14, which is mounted to rotate about a horizontal axis adjacent a conventional nose bar 16. Feed roll 14 is driven by an electric motor 18, and is designed to feed fibers downwardly from the lower end of surge section 12 onto the periphery of a large opening roll 20, which rotates beneath the nose bar 16 about a horizontal axis parallel to the axis of feed roll 14. As shown schematically in FIG. 1, the opening roll 20 is operatively connected to, and rotated by, another motor 22, which in the embodiment illustrated is shown to be mounted in a compartment 24 beneath the opening roll. Compartment 24 is positioned above an exhaust chamber 26, which is formed in the lower end of chute 10 adjacent one side thereof for a purpose noted hereinafter.

As shown in FIGS. 1 and 2, one side of the surge section 12 (the left side) is solid, while the other side (the right side) has therein a plurality of spaced ports or openings 31. Secured to the perforated side of surge section 12 over the ports 31 is a large pump housing 33, which is generally rectangular in cross section. Housing 33 has in its lower end an opening that communicates with the upper end of a tapered duct or throat section 35 of chute 10, which is nearly V-shaped in cross section. At its lower end the throat section 35 has a narrow discharge opening 36, which extends the width of chute 10, and which communicates with the space formed between the opening roll 20 and the adjacent side wall 37 of the chute 10.

The opening roll 20, which rotates clockwise as shown in FIG. 1, has a fiber discharging section which confronts the side wall 37 of the chute 10 beneath the duct opening 36, and which discharges fibers tangentially and downwardly into the lower, formation section 38 of chute 10. The formation section 38, which is generally rectangular in cross section, extends downwardly adjacent the exhaust chamber 26, and opens at its lower end on the nip formed between a pair of feed rolls 40, which are mounted on the lower end of the chute to feed a lap or web W of fibers downwardly onto an inclined slip plate 41, which communicates with the input lickerin 42 of a carding machine or the like.

Secured at opposite ends in the opposed side walls of housing 33, and extending horizontally across the housing adjacent the perforated side wall of the surge section 12 is a cylindrical shaft or rod 44. Mounted to oscillate on shaft 44 is a sleeve 45, which has intermediate its ends a radially projecting arm 46 having therein an elongate slot 47. A pin 48, which is mounted at one end for longitudinal sliding movement in the slot 47, is pivotally connected at its opposite end to one end 49 of a crank arm 50, the opposite end of which is pivotally connected to a crank pin 52 that projects from the face of an eccentric 54. Eccentric 54 is secured to the shaft 55 of a variable speed electric motor 56, which is mounted by its base plate 57 to the inside surface of the upper wall of housing 33. The crank pin 52 is radially offset from the coaxial center lines of the plate 54 and motor shaft 55, so that as the shaft 55 rotates the crank arm 50 causes the arm 46, and consequently the sleeve 45, to be oscillated about the axis of shaft 44.

Projecting from the outer peripheral surface of sleeve 45 adjacent one side thereof is an integral web portion 61, which has opposed side edges that lie in spaced planes that are disposed tangentially of the outer surface of sleeve 45 adjacent diametrally opposite sides thereof. Welded or otherwise secured adjacent their inner edges to the opposed side edges of the web section 61 are two, large, generally rectangular pump vanes or plates 63 and 64, which also lie in spaced planes disposed tangentially of the outer periphery of sleeve 45. Each of the plates 63 and 64 has in its center an opening 65 and 66, respectively, which is covered by a normally-closed, rubber flap valve 67 and 68, respectively.

As shown more clearly in FIG. 2, the flap valves 67 and 68 are mounted on the inside or left hand surfaces of the vanes 63 and 64; and plate 64 is slightly larger than plate 63, so that a flexible sealing strip 69, which is secured to the lower edge of plate 64, will have sliding engagement with an inclined surface 34 that is formed at the bottom of housing 33 to extend between its outer wall and the upper end of the chute wall 37. Plate 63 also has secured to its lower edge an elongate, resilient seal or gasket 70, which is disposed to have sliding engagement with the curved, upper surface of an arcuate sealing plate 72, which projects from the lower end of the perforated wall of housing 33 adjacent the upper end of the throat section 35.

In use, the two pump vanes 63 and 64 oscillate about the axis of shaft 44 between their solid and broken line positions, respectively, as shown in FIG. 1. During this movement, assuming that a supply of fibers is positioned in each of the surge and formation sections of chute 10, and that the motors 18, 22, and 56 and the feed rolls 40 and the lickerin 42 of the associated card are in operation, the oscillating vanes 63 and 64 perform two functions; first, vane 64 intermittently forces air downwardly through the throat section 35 of the chute to compact the fibers in the formation section 38; and secondly, vane 63 produces a vibratory effect on the fibers located in the surge section 12 of the chute by forcing air through the chute openings 31 each time the vane is swung into its closed or broken line position (FIG. 1) against the perforated wall of the surge section.

For example, during operation, the pneumatic fiber supply system is maintained at a pressure greater than the atmospheric pressure of the surrounding room, so that air and fibers are delivered downwardly into the surge section 12 of the chute, where the fibers collect above the opening roll 20, while the air continues downwardly through the ports or openings 31 in the inside wall of the surge section 12, then downwardly through the throat section 35 of chute 10, past the opening roll 20 and downwardly through the formation chute and any fibers collected therein, and then through openings 74 and 75 in the walls of the discharge chamber 26 to the surrounding room. As a result of this operation a pressure drop or pressure differential exists as between the upper and lower ends of chute 10, as well as between the upper and lower ends of each of the surge and formation sections of the chute. This differential pressure across a respective section of the chute can be expressed as $\Delta p = p_1 - p_0$, where $p_1$ equals the air pressure adjacent the upper end of the chute section, while $p_0$, which is the lower value, represents the air pressure in the lower end of the section, or adjacent the perforations 31 in the case of the surge section 12.

As a result of this differential pressure the column of fibers located in the surge section 12 is compressed under the influence of the pressure drop or differential $\Delta p$. However, during operation of the motor 56, the pressure in the lower end of chute section 12 is periodically increased by the action of the pump vane 63, which momentarily creates a reversed differential pressure that overcomes the transport pressure $p_1$ in section 12 and thereby momentarily lifts the column of fibers in section 12. As soon as vane 63 begins to swing counterclockwise (FIG. 1) away from the perforated wall of section 12 toward its outermost or full-line position as shown in FIG. 1, it creates a slight vacuum or suction adjacent the openings 31 in the perforated wall of section 12, thus increasing the transport pressure $p_1$ in section 12 and consequently causing the column of fibers to be forced downwardly or compacted into the lower end of the chute section 12.

During the initial counterclockwise movement of the vanes 63 and 64, the flap valve 67 on vane 63 remains closed, at least until the vacuum created above the seal plate 72 reaches a predetermined value, at which time the valve 67 will automatically open to prevent any further increase in the value of the vacuum caused by the counterclockwise movement of vane 63. The pressure at which valve 67 is caused to open can be adjusted by selecting the size of the opening 65 and the size and composition of the flap valve 67.

The flap valve 68 is provided on the vane 64 to prevent the creation of any vacuum by vane 64 in the upper end of the throat section 35 during counterclockwise movement of this vane. Thus, as vane 64 swings counterclockwise (FIG. 2), if the pressure in the housing 33 below the vane 64 drops below atmospheric pressure, the flap valve 68 will open automatically to allow air from the surrounding room to enter housing 33 through openings 77 in its outer wall, and through the opening 66 to the throat section 35. On the other hand, during the pivotal movement of the vane 64 clockwise about the axis of shaft 44, valve 68 remains closed and enables vane 64 to compress the air in the lower end of housing 33 and to force it downwardly through the throat 35 to create a surge of compressed air which tends to compact the fibers in the lower, formation section 38 of the chute 10, as previously noted.

Figure 3:
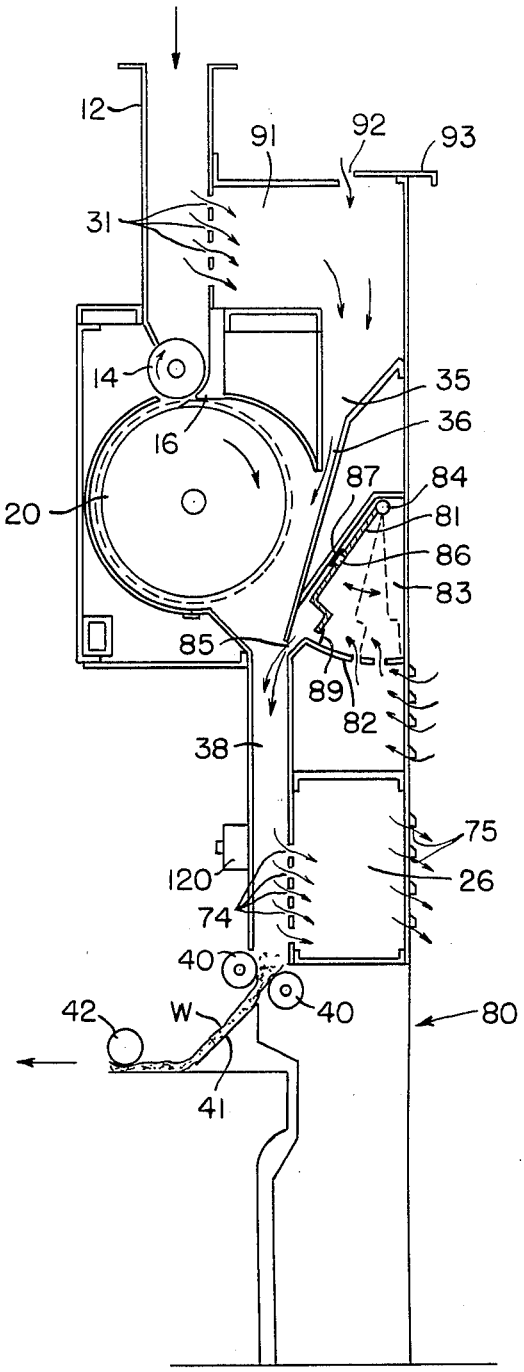
FIG. 3 is a schematic end view similar to FIG. 1, but showing a modified form of the feed chute and air pump.

In the embodiment illustrated in FIG. 3, wherein like numerals are employed to denoted elements similar to those employed in the first embodiment, 80 denotes generally a modified fiber feeding chute in which a single volumetric pump vane 81 is fixed at its upper end to a shaft 84 for oscillation thereby in a chamber or housing 83, which is formed in the chute beneath a horizontal plane extending approximately through the center of the opening roll 20. As in the case of the previous embodiment, the pump vane 81 has in its center an opening 86 which is covered by a normally-closed, flexible flap valve 87. Also it has attached to its lower edge a flexible gasket or sealing strip 89, which slides on a curved, perforated bottom wall 82 of housing 83. Housing 83 has in its lower, inside edge an elongate discharge opening 85, which communicates with the upper end of the formation section 38 of chute 80.

In use, the air under pressure which conveys fibers to the surge section 12, passes through the apertures 31 into a re-entrant chamber plenum 91, which is mounted on the side of the surge section 12 in the area occupied in the prior embodiment by the pump housing 33. The plenum 91 has in its upper end an opening 92 covered by a manually operable valve plate 93, which can be adjusted to control the amount of atmospheric air which is admitted to the plenum for travel downwardly through the chute throat 35 toward the opening roll 20. It is to be noted that while the throat section 35 of chute 80 opens as at 36 adjacent the point where fibers are discharged from the opening roll 20, this embodiment differs from the preceding embodiment by virtue of the fact that the discharge opening 85 for the pump housing 83 is located vertically beneath both the throat discharge opening 36 and the point at which fibers are discharged tangentially from the opening roll. As a consequence, the surges of compressed air generated by the pump vane 81 enter chute 10 at a point beneath the opening roll 20, and therefore do not have any effect on the air traveling downwardly through the throat section 35 and past the point at which fibers are discharged from the roll 20. This enables a more uniform flow of air past the opening roll 20 and a more uniform doffing of fibers from the roll.

It will be noted that the flap valve 87 is mounted on the left hand side of the pump vane 81 as shown in FIG. 3, so that it normally is closed when the vane is swung clockwise to compress air into the discharge opening 85. On the other hand, when vane 81 is swung counterclockwise from its full line position toward its broken line position as shown in FIG. 3, the valve 87 is free to open in response to the atmospheric air entering through the ports in the lower wall section 82, thereby to prevent creation of any undesirable vacuum adjacent opening 85 in housing 83. Also, although not illustrated, it is to be understood that shaft 84 is connected, as in the first embodiment, with a variable speed motor 56, which can be mounted at any convenient spot on chute 80. Likewise, although the drive motors for the feed roll 14 and opening roll 20 are not illustrated, they can be mounted in any convenient spot on the chute 80, as will be readily apparent to one skilled in the art.

Figure 4:
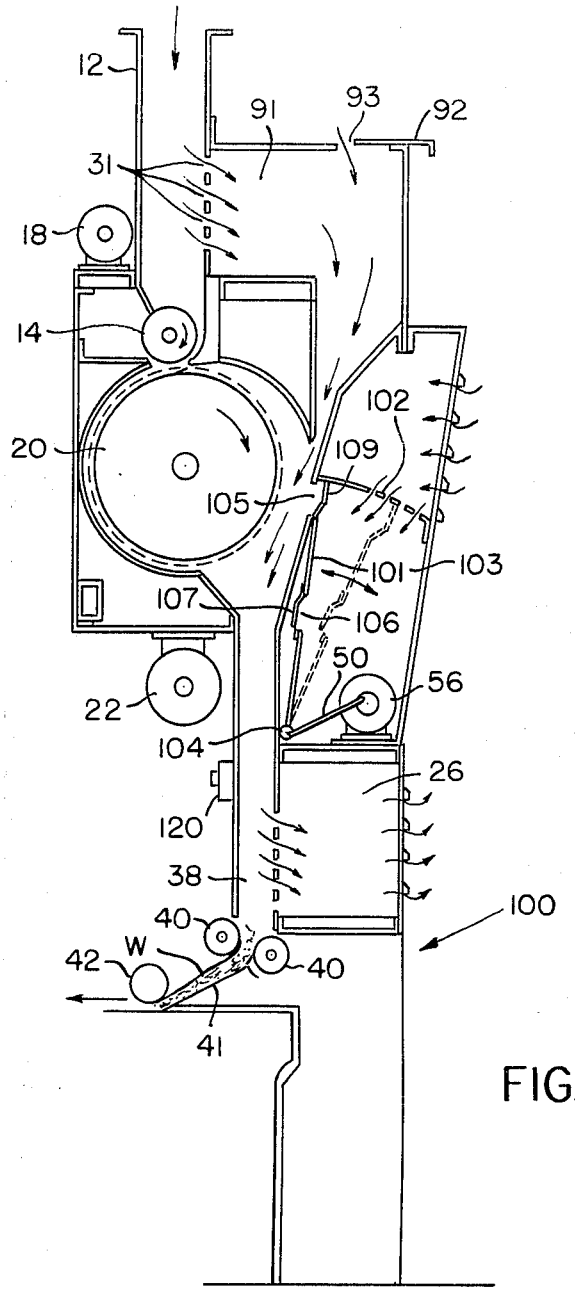
FIG. 4 is a schematic end view of still another embodiment of this feed chute and associated air pump.

In the embodiment shown in FIG. 4, wherein like numerals are again employed to denote elements similar to those described in the preceding embodiments, 100 denotes generally a modified feed chute having a volumetric pump, as represented by the single pump vane 101. This vane is oscillatable in a chamber or housing 103, which is mounted on one side of the chute 100 beneath and to one side of the opening roll 20. Vane 101 is secured at its lower end to a shaft 104, which is oscillatable in the usual manner by a crank arm 50, which is driven by a motor 56 that is mounted in the lower end of chamber 103. The upper end of vane 101 has thereon the usual sealing strip 109 which slides on the inside surface of a perforated, curved upper wall 102 of housing 103. As in the preceding embodiments, a central opening 106 in the vane 101 is covered by a flexible flap valve 107.

In this embodiment chamber 103 has in its upper end, and along its inside wall adjacent its opening roll 20, an elongate discharge opening 105, which opens on the interior of chute 100 above the upper end of its formation section 38, and immediately beneath the point at which fibers are doffed or discharged from the periphery of the opening roll—i.e., just beneath a horizontal plane extending through the center of roll 20. As in the embodiment shown in FIG. 3, when the vane 101 is oscillated it compresses air during its counterclockwise movement toward the opening 105. The compressed air is discharged through the opening 105 and downwardly toward the formation section 38 of the chute, but from a point beneath the center of roll 20 so as to minimize its effect on the doffing of fibers from the roll. During the counterclockwise movement of vane 101 the valve 107 remains closed, but as the vane returns clockwise from its full line position to its broken line position as shown in FIG. 4, the flap valve 107 is opened by the atmospheric pressure entering the perforated upper wall 102 of the housing 103, if necessary, in order to prevent the creation of a vacuum in housing 103 adjacent the discharge opening 105.

In each of the preceding embodiments a pressure sensor 120 has been shown attached to the respective chute 10, 80 and 100 in communication with the interior of the formation section 38 of each chute adjacent its upper end. Each sensor 120 senses the static pressure, which is dependent upon the height of the column of fibers and the pump pressure developed in the respective chute. This sensor, which may be of the LVDT type that is disclosed in U.S. Pat. No. 4,240,180, and which can be purchased from Schaevitz Engineering, can be utilized to provide a signal voltage which controls the speed of the feed roll 14 and the shaft of the pump motor 56.

Figure 5:
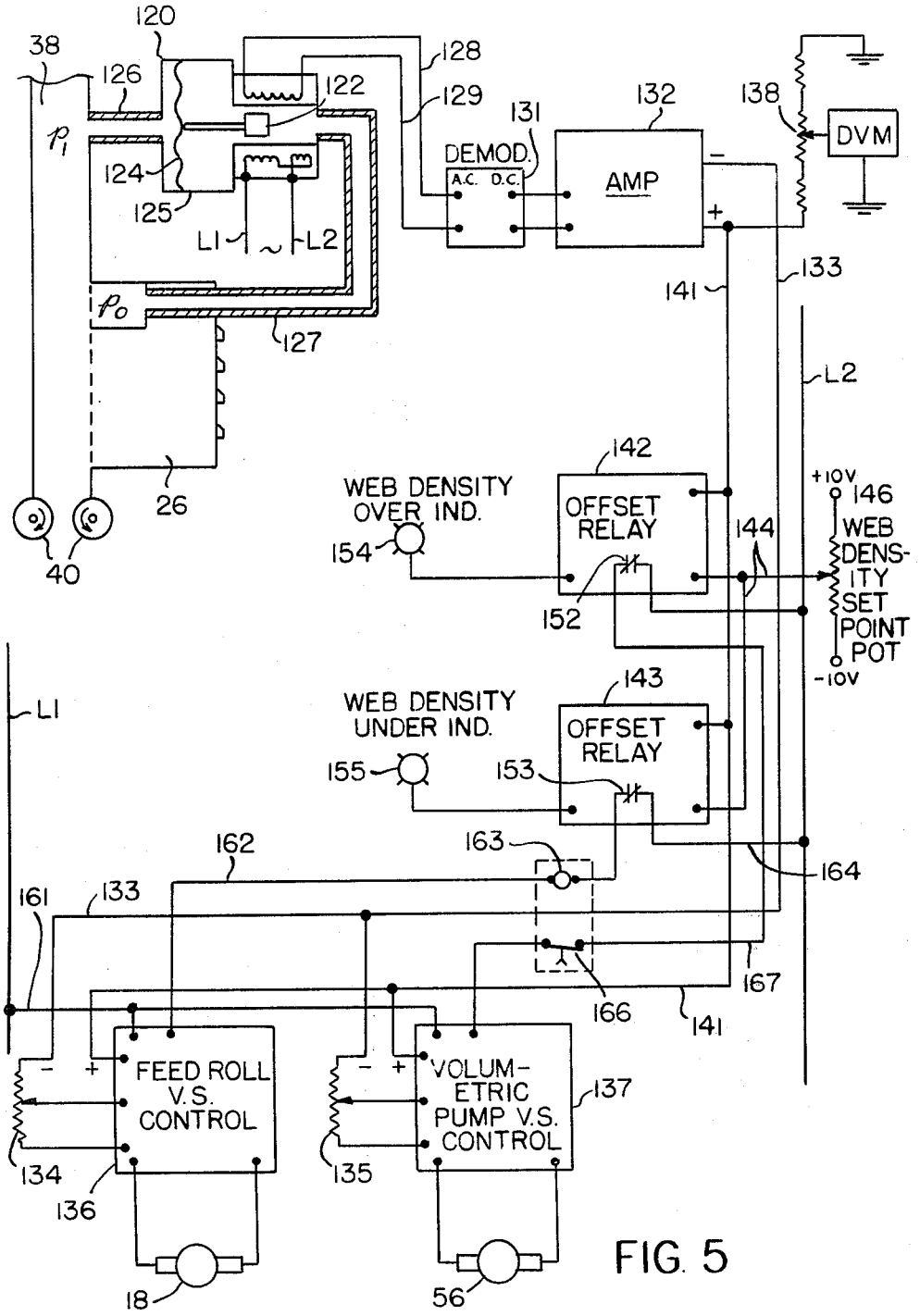
FIG. 5 is a wiring diagram illustrating schematically one manner in which the pump motor and feed roll motor for an associated feed chute can be controlled to produce a web having a desired density and uniformity of fiber distribution.

For example, as shown in FIG. 5, sensor 120 comprises a magnetic core 122, which is fastened by a stem 123 to a metal diaphragm 124 that is secured around its periphery in the sensor housing 125. Housing 125 communicates at one end by a tube 126 with the interior of a chute adjacent the upper end of formation section 38, and communicates at its opposite end through another tubular section 127 with the interior of the same formation section 38 adjacent the lower end thereof. As a consequence, any change in the density of the column of fibers in the chute section 38 will produce a corresponding change in the pressure differential between opposite ends of the sensor housing 125. This will therefore cause a corresponding movement of the diaphragm 124 and core 122, thus producing a corresponding change in the signal output generated on lines 128 and 129 by the sensor coil in the sensor 120.

The output signals on lines 128 and 129 are applied to a demodulator 131, which changes the AC signal to a DC signal, which is then amplified by an amplifier 132. The negative output signal from the amplifier 132 is applied by a line 133 to the negative DC input terminals of a pair of speed control potentiometers 134 and 135, which form parts of conventional speed control units 136 and 137, respectively. These control units, which are similar to those disclosed in the above-noted U.S. Pat. No. 4,240,180 are adapted to control the feed roll motor 18 and the volumetric pump motor 56, respectively.

The positive output signal of the amplifier 132 is applied through a potentiometer 138 to the input of a digital voltmeter (DVM), which is used to provide a visual readout of the density of the web W produced at the output of the feed chute.

The positive signal from amplifier 132 is also applied by a line 141 to the inputs of a pair of offset relays 142 and 143, as well as to the positive DC input terminal of each of the controllers 136 and 137. Each of the offset relays 142 and 143 also has another input connected by a line 144 to a web density set point potentiometer 146, which can be adjusted to apply to the other input of each relay 142 and 143 a voltage which is representative of the desired density of the web produced at the output of the feed chute.

Each relay 142 and 143 includes a SPDT relay and comparator circuit for operating its normally-closed relay switches 152 and 153, respectively. When the value of the compared input signals of a respective relay 142 or 143 equals or exceeds the value determined by the set point potentiometer 146, the associated relay coil will be energized to open the respective relay switch 152 or 153. However, to provide a margin of error, each relay 142 and 143 also includes a manually adjustable potentiometer (not illustrated), which can be adjusted to offset the operating voltage of the associated relay coil either above or below the voltage determined by the set point potentiometer 146. In the case of relay 142 this value is offset in one direction so that whenever the density of the web W exceeds by a predetermined amount the preset value as determined by the pot 146, the relay 142 will be energized and will open its associated switch contacts 152. The relay 143, on the other hand, is adjusted so that whenever the density of the web, as detected by comparison of the two input signals to the relay 143, falls a predetermined amount under or below the preset value, then the coil of the relay 143 is energized to open the normally-closed contacts 153. Thus, if the density of the web W becomes too great switch 152 opens; and if the web density is too low, switch 153 will be opened.

Indicator lamps 154 and 155 are connected in circuit with the coils of the relays 142 and 143, respectively, so that whenever the relay 142 is energized lamp 154 will be energized to provide a visual indication that the density of the web is too great. Conversely, when the coil of relay 143 is energized, lamp 155 will be energized to indicate that the web density is too low. Obviously other, equivalent indicator means, such as an audible warning system, could be employed in addition to, or in lieu of, the lamps 154 and 155.

The AC power for energizing the motors 18 and 56 is supplied to these motors through their associated speed control units 136 and 137, respectively. As shown at the left side of FIG. 5, power from one side of the AC power supply, as represented by the line L1, is applied through a line 161 to one of the AC input terminals of each of the control units 136 and 137. The other AC input terminal of control unit 136 is connected by a line 162 to one side of a relay coil 163, the opposite side of which is connected through the relay switch 153 and the line 164 to the other side of the AC power supply, as represented by line L2. The second AC input terminal to the unit 137 is connected through a time-delayed opening switch 166, which is controlled by the relay coil 163, and a line 167 and the normally-closed switch contacts 152 to line L2.

During normal operation, as when the density of the web W remains satisfactory, the DC signals applied to the control units 136 and 137 will raise or lower the respective speeds of motors 18 and 56 as may be necessary to maintain proper web density. However, whenever the relay switch 152 is opened, as when the density of the web W becomes too great, AC power to the control unit 137, and hence to the pump motor 56, is interrupted and thereby stops the operation of the associated pump vane or vanes. Since at this time power continues to be supplied to the control unit 136 for the feed roll motor 18, the feeding apparatus continues to operate and the density of the thus-produced web will decrease, because the volumetric air pump is no longer in operation. In due course, therefore, the density will fall below the limit set by the relay 142, and as soon as this occurs the relay switch 152 once again closes and reenergizes the associated volumetric air pump.

On the other hand, in the event that the density of the web falls below the minimum value determined by the offset relay 143, this relay will open the switch 153, thereby deenergizing the relay coil 163 and removing power to the control unit for the feed roll motor 18, which is therefore deenergized. However, for the period of time that it takes the delayed-opening switch 166 to open, the pump motor 56 remains energized and continues to compact the fibers in the formation section 38 of the chute, and thus continues to increase the density of the fibers in this section of the chute. If the density increases sufficiently before the switch 166 opens, the coil in relay 143 will be reenergized, thereby once again closing switch 153 and reenergizing relay 163 and the feed roll motor 18 without having deenergized motor 56.

From the foregoing it will be apparent that the present invention provides very accurate means for controlling the density of the web or lap produced by fiber feeding chutes of the type disclosed herein. The volumetric air pumps disclosed herein provide relatively simple and reliable means for compacting, as necessary, the fibers located in the formation sections 38 of the chutes 10, 80 and 100, thus enabling the production of a web or lap of extremely uniform density. Moreover, the respective air pump can be designed to vibrate the fibers in the surge section 12 of a chute while simultaneously compacting the fibers in its formation section, or the pump can be located beneath the opening roll to provide compacting means which operates without intefering with the air flow in the chute past the doffing point of the associated opening roll. Or if desired, two volumetric pumps could be employed in the system at the same time; one positioned as in FIG. 1 to compact the fibrous supply in the surge section, and the other being located as in FIG. 3 or FIG. 4 to compact fibers in the formation section.

Still another advantage of this invention is that the novel control means disclosed herein enables automatic control of the speed of each motor 18 and 56, thereby automatically to control the density of the fiber column in the formation section of a chute, and consequently in the web or lap produced at the output of the chute. Since the density of the column of fibers in the formation section of a chute is proportional to the density in the web which is produced at the output of the chute, it is possible to produce a web of any desired density, for example by setting the pot 146 and making the desired over and under limits by adjustment of the pots contained in the offset relays 142 and 143. Also, the control means provides means for selectively interrupting power to the feed roll and pump motors to prevent the formation of completely unsatisfactory webs.

While only certain embodiments of the invention have been illustrated and described in detail herein, it will be apparent that the invention is capable of still further modification, and that this application is intended to cover any such modifications as may fall within the scope of one skilled in the art or the appended claims.

What I claim is:

1. In a system for pneumatically feeding airborne fibers to a feed chute having intermediate its ends at least one feed roll for feeding fibers from a supply thereof adjacent one end of the chute to a formation section adjacent the opposite end of the chute, apparatus for controlling the density of the column of fibers formed in the formation section of the chute, comprising means for sensing the existing air pressure differential between opposite ends of said formation section, means for generating a first electrical signal the voltage of which varys in proportion to changes in the pressure differential detected by said sensing means, means for generating a second electric signal having a set voltage which is proportional to the desired pressure differential in said formation section, first feed roll control means responsive to said first signal to increase the rate of rotation of said feed roll as said pressure differential decreases, and vice versa, second feed roll control means for interrupting the operation of said feed roll when the voltage of said first signal exceeds one of two predetermined limits above and below, respectively, the voltage of said second signal, pump means for intermittently supplying pulses of compressed air to one end of said formation section of said chute to compact the column of fibers therein, and first control means for said pump means responsive to said first signal to increase the rate at which said pulses are supplied to said formation section as said pressure differential decreases, and vice versa.

2. A system as defined in claim 1, including second control means for interrupting the operation of said pump means when the voltage of said first signal exceeds the other of said two predetermined limits.

3. A system as defined in claim 2, wherein said one predetermined voltage limit is proportionate to the desired minimum density of the column of fibers in said formation chute, and said other predetermined voltage limit is proportionate to the desired maximum density of said column of fibers.

4. A system as defined in claim 1, wherein said pump means comprises a pump chamber formed on said chute and having a discharge opening communicating with said one end of said formation section of the chute, a pivotal pump vane mounted in said chamber, and an electric motor connected to said vane and responsive to said first pump control means to oscillate said vane toward and away from said discharge opening to force pulses of compressed air through said opening into said formation section of the chute.

5. A system as defined in claim 4, wherein said chamber communicates through a second discharge opening with said one end of said chute and the supply of fibers therein, and said pump means includes a second pivotal pump vane oscillatable by said motor toward and away from said second discharge opening to supply pulses of compressed air to the supply of fibers contained in said one end of said chute.

6. Apparatus for controlling the density of a column of fibers produced in the formation section of a pneumatic fiber feeding chute of the type having intermediate its ends an opening roll and an associated feed roll for feeding fibers from a surge section in the upper end of the chute to a formation section adjacent the lower end of the chute, comprising pump means for intermittently supplying compressed air to the upper end of said formation section of the chute to compact the column of fibers therein, a first electric motor for operating said pump means, a second electric motor for operating said feed roll, and control means for said motors operative automatically to reduce the speed of said motors as the density of said column of fibers increases, and to increase the speed of said motors as the density of said column of fibers decreases.

7. Apparatus as defined in claim 6, wherein said control means includes means for stopping said first electric motor when the density of said column of fibers exceeds a predetermined value, and means for stopping both said first and said second motor when said density of said column of fibers falls below a predetermined value.

8. Apparatus as defined in claim 7, wherein the last-named means includes means for momentarily delaying the stopping of said first motor after said second motor has stopped.

9. Apparatus as defined in claim 6, wherein said control means comprises means for monitoring the air pressure differential between the upper and lower ends, respectively, of said formation section of the chute, means for generating an electric signal the voltage of which is proportional to said pressure differential, and signal responsive means interposed between said signal generating means and said motors and operative to vary the speeds of said motors in response to changes in the voltage of said generated signals.

10. Apparatus as defined in claim 9, including a meter connected to said signal generating means to provide a visual indication of the density of said column of fibers at any given instant.

11. Apparatus as defined in claim 6, wherein said pump means comprises an oscillatable pump vane mounted to pivot about one edge thereof in a pump chamber on said chute, said chamber communicating adjacent one side thereof with the atmosphere, and having a discharge opening adjacent the opposite side thereof in communication with the upper end of said formation section of the chute, and means connects said vane to said first motor for oscillation thereby between opposite sides of said chamber, thereby intermittently to force pulses of compressed air through said discharge opening into said formation section to compact the column of fibers therein.

12. Apparatus as defined in claim 11, wherein said chamber is located above said opening roll and has its discharge opening positioned slightly above and in registry with the doffing section of said opening roll, said surge section of said chute has a perforated wall section defining one wall of said pump chamber, and said pump means includes a second oscillatable pump vane connected to said first motor for oscillation thereby toward and away from said perforated wall section of said chute thereby periodically to supply pulses of compressed air to the supply of fibers located in said surge section of the chute.

13. Apparatus as defined in claim 11, wherein said chamber is located adjacent the doffing side of said opening roll and has its discharge opening communicating with said formation chamber at a point below the doffing point of said opening roll.

14. Apparatus as defined in claim 13, including a flexible valve positioned over an opening in said vane normally to be closed as said vane is swung toward said discharge opening, and operative to be opened by atmospheric pressure during movement of said vane away from said discharge opening thereby to prevent creation of a vacuum at said discharge opening.

* * * * *